US006467423B1

(12) United States Patent
Poldervaart

(10) Patent No.: US 6,467,423 B1
(45) Date of Patent: Oct. 22, 2002

(54) SEMI-WEATHERVANING ANCHORING SYSTEM

(75) Inventor: Leendert Poldervaart, La Turbie (FR)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 09/722,020

(22) Filed: Nov. 27, 2000

Related U.S. Application Data

(62) Division of application No. 09/220,376, filed on Dec. 24, 1998, now Pat. No. 6,216,628.

(51) Int. Cl.[7] ..... B63B 21/24
(52) U.S. Cl. ..... 114/293
(58) Field of Search ..... 114/293, 230.1, 114/230.12, 230.2, 230.21, 230.22, 230.23, 230.24

(56) References Cited

U.S. PATENT DOCUMENTS

| | | | |
|---|---|---|---|
| 3,138,135 | A | 6/1964 | Langer |
| 3,422,783 | A | 1/1969 | Moulin |
| 3,583,354 | A | 6/1971 | Flickinger |
| 3,620,181 | A | 11/1971 | Naczkowski |
| 3,822,663 | A | 7/1974 | Boschen, Jr. |
| 3,886,882 | A | 6/1975 | Thornburg et al. |
| 4,090,462 | A | 5/1978 | Mount |
| 5,025,743 | A | 6/1991 | Pollack |
| 5,062,376 | A | 11/1991 | Tremblay |
| 5,937,780 | A | 8/1999 | Ethridge et al. |

FOREIGN PATENT DOCUMENTS

| | | |
|---|---|---|
| DE | 3535091 | 4/1987 |
| FR | 2385584 | 10/1978 |
| GB | 2061850 | 5/1981 |
| GB | 2087819 | 6/1982 |
| JP | 56017782 | 2/1981 |
| JP | 56135386 | 10/1981 |
| JP | 61049008 | 3/1986 |
| JP | 1148688 | 6/1989 |
| WO | WO 9723380 | 7/1997 |

*Primary Examiner*—S. Joseph Morano
*Assistant Examiner*—Andrew Wright
(74) *Attorney, Agent, or Firm*—Young & Thompson

(57) ABSTRACT

A vessel includes at least two anchor lines connected respectively at a substantially fixed position near the bow and near the stern of the vessel. At least one of the anchor lines includes at least two branching anchor lines each connected with one end to the anchor line in a connection point and connected with the other end to the seabed. By means of this system, a stable anchoring arrangement is achieved in which the sides of the vessel are easily accessible by for instance a shuttle tanker. The system also allows for a weathervaning action through relatively small angles, for instance between 0 and 90°. In another embodiment, at least one of the anchor lines is connected to a substantially fixed position pulling system such as a winch system for lengthening or shortening the anchor lines. For providing a weathervaning action through a range of about 0° and 90°, the anchor lines are maintained in a tensioned state by the winch system and are varied in length. In an embodiment the winch system varies the length of the anchor lines simultaneously. The anchor lines near the bow and the stern can be formed of a single anchor line which is connected to a single winch such that the anchor line which is payed out at the bow is taken in at the stern and vice versa.

2 Claims, 5 Drawing Sheets

SEMI-WEATHERVANING ANCHORING SYSTEM

This application is a continuation divisional of Application No. 09/220,376, filed on Dec. 24, 1998, now U.S. Pat. No. 6,216,628 the entire contents of which are hereby incorporated by reference.

BACKGROUND AND SUMMARY OF THE INVENTION

The invention relates to a vessel comprising at least two anchor lines connected respectively at a substantially fixed position near the bow and near the stem of the vessel.

From U.S. Pat. No. 3,583,354 a bow-stem spread catenary mooring system is known in which the vessel is maintained in a fixed position by means of four anchor lines, two of which are connected to the bow of the vessel and two at the stem. By applying the correct tension to these anchor lines it is possible in normal weather to maintain the ship in a reasonably fixed position. According to U.S. Pat. No. 3,583,354, during storn conditions the stem anchor lines are slackened, such that the vessel can weathervane around the bow through 90°.

From U.S. Pat. No. 3,822,663, a weathervaning vessel is known, which is anchored to the seabed by means of four anchor lines. The vessel is provided with a track which encircles the hull of the vessel. A plurality of movable carriages are guided along the track, one anchor line being connected to each carriage. The carriages can be placed at specific points along the track, each carriage being equipped with a winch for accumulating or discharging a respective anchor line. By moving the position of the carriages along the track, and by selectively paying in or paying out the anchor lines, the vessel can weathervane about a substantially fixed position point located between the bow and the stern. The known anchoring construction however is relatively complex and the anchor line arrangement covers a relatively large part of the seabed. Hence the anchor lines may interfere with the operating area for the risers and leaves little room for the anchoring spread of a drilling/workover rig when such a rig is anchored next to, or in close proximity to the drilling vessel.

It is therefore an object of the present invention to provide for a vessel which can weathervane within a predetermined area, in a controlled manner, using a relatively simple anchoring system. It is a further object of the present invention to provide a vessel comprising such a weathervaning anchoring system having a reduced anchoring layout and leaving a relatively large seabed area for the risers and for the anchoring spread of adjacent vessels such as drilling/workover rigs or shuttle tankers.

Thereto the vessel according to the present invention is characterised in that at least one anchor line comprises a first line section extending to a connection point located below keel level of the vessel and at least two branching anchor lines, each connected with one end to the anchor line in the connection point and connected with the other end to the sea-bed. With the above anchoring arrangement the vessel according to the present invention can be easily accessed along its sides. Thereby other vessels can easily approach and moor aside the vessel according to the present invention, and sufficient space is available for location of for instance flexible risers.

By providing at least one anchor line with two branching anchor lines, a very stable multiple point mooring system (at least a three point system) is provided which will leave enough play for the vessel to weathervane through angles less than 90° in both directions. Preferably both the bow and the stem anchor lines each comprise at least two branching anchor lines.

In one embodiment, the anchor lines extend substantially vertically downward. Hereby access of the vessel is further increased.

As used herein, the term "substantially vertical" shall mean a position from the first anchor line section being inclined from the vertical position by no more than 45 degrees.

In another embodiment, a buoyancy member is connected near the branching anchor lines. In this way, the stiffness of the anchor arrangement can be adjusted for varying the weathervaning action.

The term "anchor line" as used herein comprises anchor cables, ropes, chains or combinations thereof.

In one embodiment, at least one anchor line extends through a generally vertical shaft extending through the hull of the vessel from deck level to keel level. In this way the anchor lines are located below the vessel, and the bow and stem are easily accessible as well.

Preferably a counterweight is connected to at least one of the anchor lines, such that the tension in the vertically extending part can be adjusted and the stiffness of the anchor line system can be varied for adjustment of the weathervaning action.

Another embodiment of a vessel according to the present invention comprises at least two anchor lines connected respectively at a substantially fixed position near the bow and near the stern of the vessel, at least one of the anchor lines being connected to a substantially fixed-position pulling device for lengthening or shortening of the anchor line, and is characterised in that the pulling device can vary the length of the at least one anchor line such that both anchor lines are maintained in a tensioned state, and the vessel can weathervane around the bow anchor line or the stem anchor line.

The invention is based on the insight that during normal operating conditions, a vessel will be subjected to wind and wave directions which are more or less constant for larger time periods. During these substantially constant conditions, the vessel only needs to weathervane through a relatively small angle such as between 0° and 90°. For these conditions, by properly tensioning and slackening at least one of the anchor lines at the bow and stem of the vessel, an efficient and controlled weathervaning action can be achieved, without the need of a complex system of displaceable winches.

In one embodiment the pulling device, such as for instance a winch system, according to the invention varies the length of the anchor lines simultaneously. Variation of the anchor lines can take place under the control of a mean position sensor which actuates the winch system on the basis of the mean position of the vessel, the wind or wave directions, etc. The change in one of the above environmental characteristics will change the control signal and hence the stiffness of the anchor line system.

Preferably each anchor line is connected to the pulling device via a sheave located generally at the center line of the vessel. By the placement of the sheaves on the centre line of the vessel, a symmetric weathervaning action to both sides is achieved.

According to an embodiment of the vessel according to the present invention the anchor lines are connected to a single pulling device or winch. By operation of this single pulling device, bow and stem anchor lines can be simultaneously slackened or tightened to obtain a proper weathervaning position of the vessel. In one embodiment, a single anchor line passes from the bow, via the pulling device to the stern of the vessel, such that the length of the anchor line that is for instance taken in at the bow corresponds with the length of anchor line payed out at the stem.

By passing the anchor lines through a vertical shaft or hawser pipe extending from deck level to keel level, the sides of the vessel are easily accessible, and a shuttle tanker can be moored alongside the vessel according to the present invention without interference with the anchor lines.

By connecting at least one of the anchor lines below sea level to a counterweight, which in turn is connected to the seabed, the vertical arm of the weathervaning system can be adjusted and thereby the stiffness of the weathervaning system can be varied. Preferably the vessel according to the invention is connected to a subsea hydrocarbon structure via at least one riser. The riser is connected to the side of the vessel near midship where dynamic movements are minimum thereby increasing the longevity of these risers. The riser may pass through the vessel via the moonpool. As the movements of the vessel are limited to rotations of approximately 90 degrees, the risers also do not require complicated swivels at their attachment points as the riser itself can twist this angle.

BRIEF DESCRIPTION OF THE DRAWINGS

Some embodiments of a vessel according to the present invention will be explained in detail, by way of example, with reference to the accompanying drawings. In the drawings.

DESCRIPTION OF THE PREFERRED EMBODIMENTS

Figure 1A:
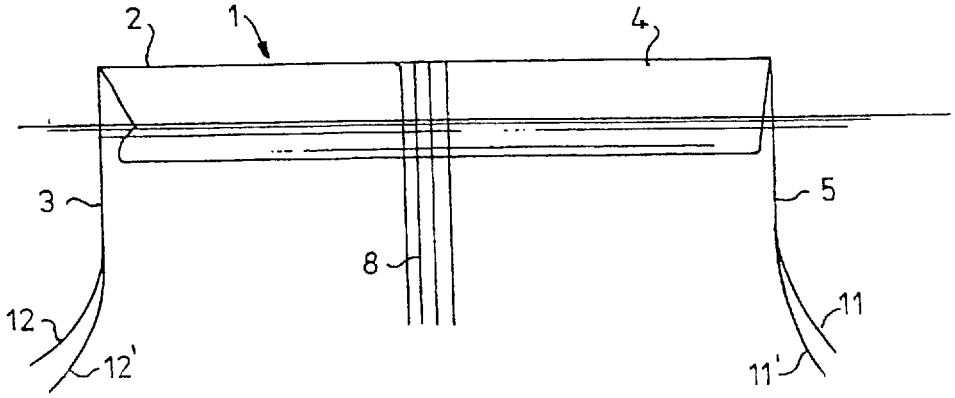
FIG. 1*a* shows a schematic side view of a vessel according to the present invention wherein the anchor lines are connected to the bow and the stern.

FIG. 1*a* shows a vessel 1 which at its bow 2 and at its stem 4 is connected to anchor lines 3 and 5. The anchor lines 3 and 5 comprise a generally vertically extending section and two branching sections 11,11', 12,12' attached to the vertical parts.

Figure 1B:
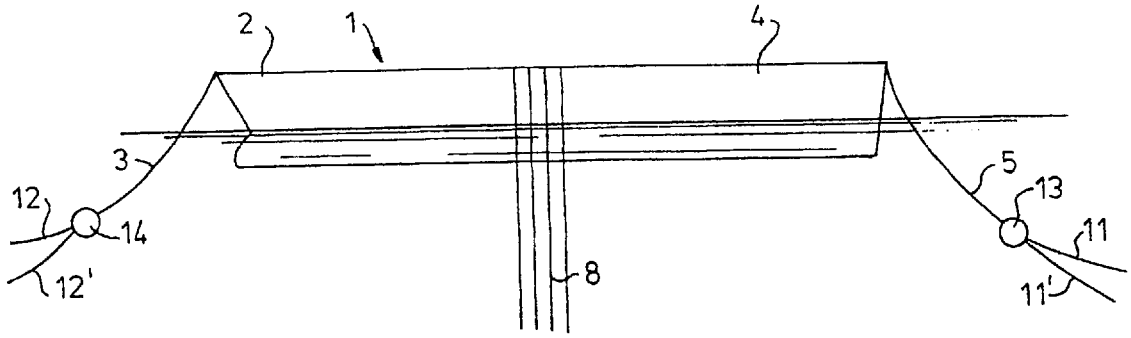
FIG. 1*b* shows an anchoring arrangement according to FIG. 1 comprising buoyancy means.

In the embodiment of figure 1*b*, submerged buoys 13,14 are attached to the stem and bow anchor lines. By positioning of the buoys 13,14, the stiffness of the anchoring system can be varied.

Figure 2:
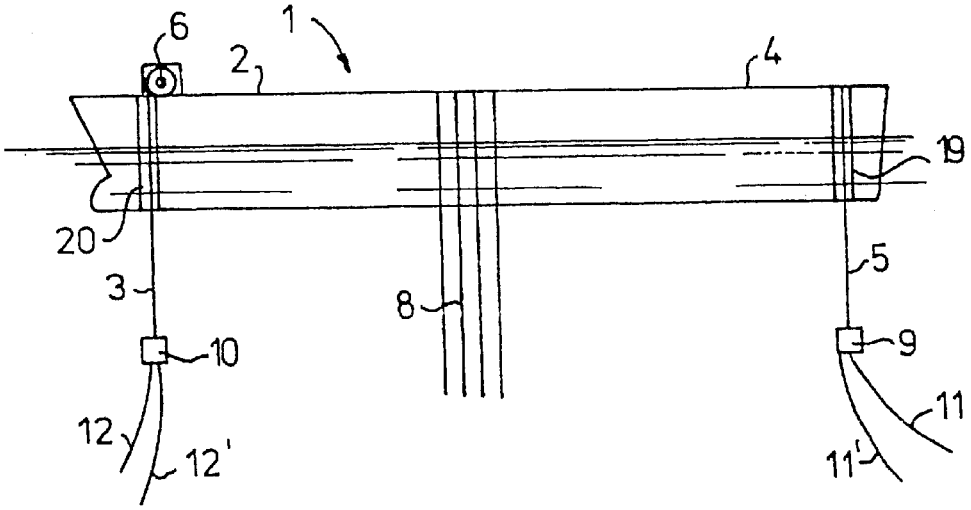
FIG. 2 shows a schematic side view in which the front most anchor line is connected to a pulling device, both front and rear anchor lines extending through a vertical shaft in the vessel.

In the embodiment shown in FIG. 2, the bow anchor line 3 is connected to a fixed position winch 6. Both stem and bow anchor lines are connected to counter weights 9 and 10. Each anchor line extends through a vertical shaft 19,20 extending from deck level to keel level. The vessel will weathervane around the anchor line which is stiffest. If both anchor lines have the same stiffniess and the winch 6 pays out bow anchor line 3, the vessel will weathervane around the stem anchor line 5 because this anchor line is relatively stiffer than anchor line 3. In reverse, if winch 6 takes in bow anchor line 3, then the vessel will be weathervaning around anchor line 3 because this anchor line will be stiffer than the stem anchor line 5.

Figure 3:
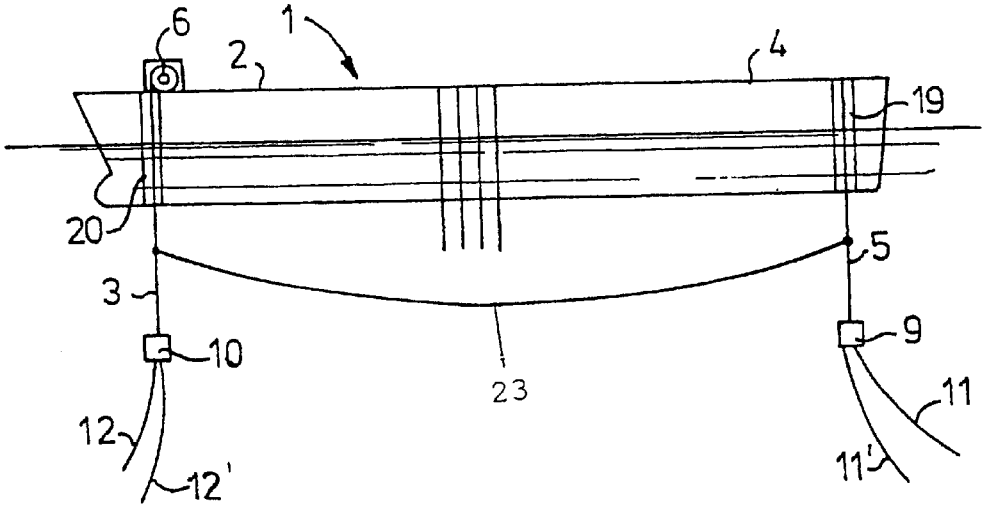
FIG. 3 shows a schematic side view of a vessel wherein the anchor lines at the bow and at the stern are mutually connected to a cable, the bow anchor line being connected to a winch.

In the embodiment shown in FIG. 3, the bow anchor line and stein anchor line are mutually connected by a cable 23. By adjusting the length of the bow anchor line 3 by operation of the winch 6, the stern counter weights 9 will be lifted or lowered and the stiffness of the system will be varied for adjustment of the weathervaning action thereof.

Figure 4:
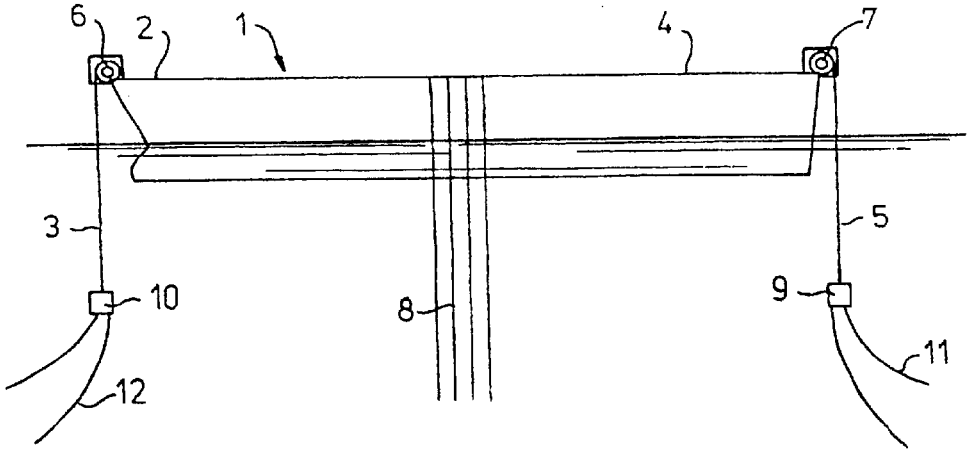
FIG. 4 shows a schematic side view of an embodiment of a vessel according to the present invention wherein each anchor line is connected to a separate winch.

FIG. 4 shows a vessel 1 with at its bow 2 and its stem 4 respective winches 6,7. To each winch 6,7 an anchor line 3,5 is connected. The anchor lines 3,5 may be comprised of ropes, chains or cables. Each anchor line 3,5 in the present embodiment is connected to a counterweight 9,10 which counterweight in turn is connected to the seabed by means of chains or cables 11,12. The stiffniess of the weathervaning system according to the present invention may be adjusted by changing the weight of the counterweight 9 and 10 or by changing the length of the vertical arm (vertical part of the anchor line 3,5). The use of the counterweights 9 and 10 however is optional, and instead thereof buoys could be used as in FIG. 1*b*.

Risers 8 are connected near midship of the vessel 1, which risers are connected to a subsea oil or gas structure which is not shown in the drawings.

Figure 5:
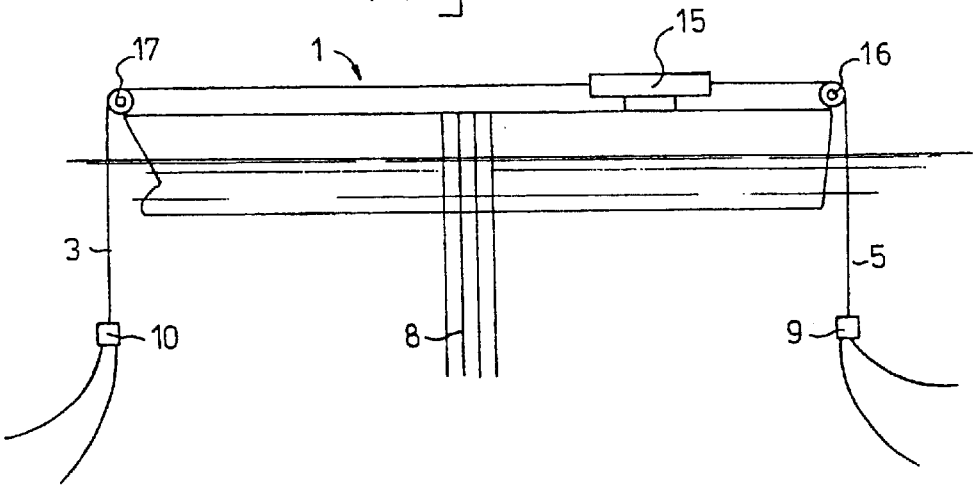
FIG. 5 shows a schematic side view of an embodiment wherein the anchor lines are connected to a single winch.

FIG. 5 shows an embodiment wherein the anchor lines 3,5 are connected to a fixed position sheave 16,17 at the stem and bow of the vessel The anchor lines are connected to a single winch 15 on the vessel 1.

Figure 6:
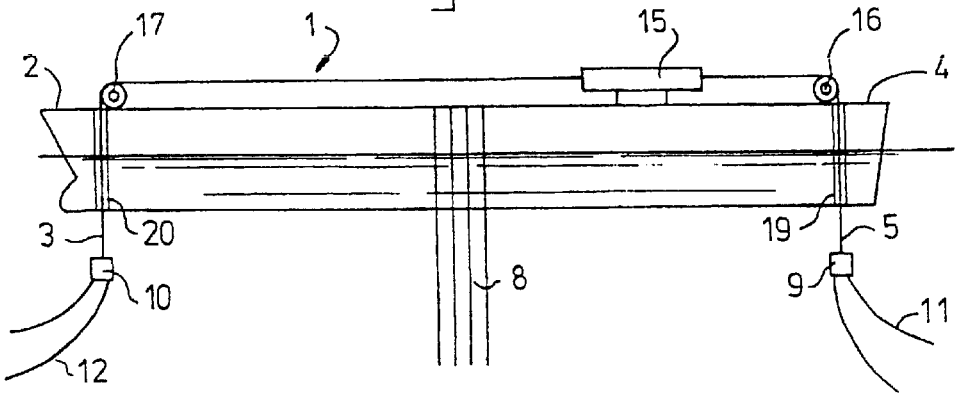
FIG. 6 shows an embodiment wherein the anchor lines are passed through vertical shafts in the vessel.

In the embodiment of FIG. 6, each anchor line 3,5 is passed through a vertical shaft 19,20 extending from deck level to keel level through the hull of the vessel 1. In this way, the anchor lines 3,5 stay clear from the sides of the vessel and do not interfere with other vessels which need to moor alongside the vessel 1 according to the present invention.

For proper weathervaning at reduced torque, a chain swivel may be included in one of the anchor lines 3,5 or in both anchor lines, to allow the anchor line segments attached to said chain swivel to rotate along their longitudinal axis. For safety, it is preferred if the anchor lines 3,5 are formed by two or more parallel anchor line members, which may be comprised of chain, cable, rope or any combination thereof.

Figure 7:
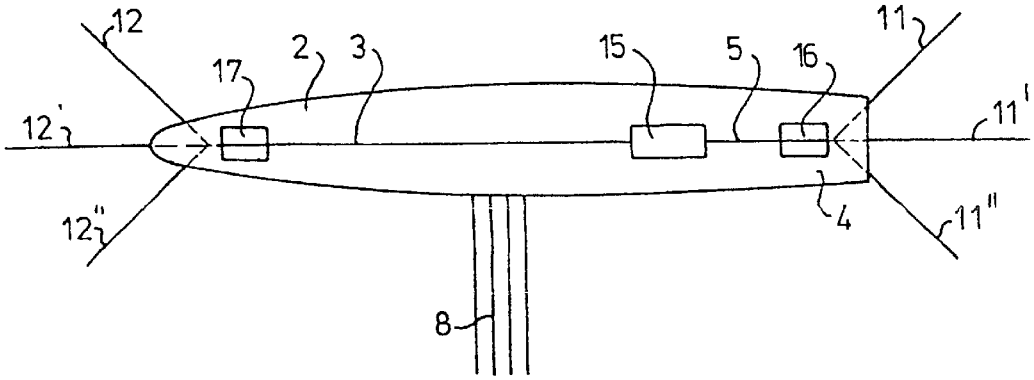
FIGS. 7 and 8 show a schematic plan view of the vessel according to the present invention in different weathervaning positions.

As can be seen in FIG. 7, the sheaves 16 and 17 and the winch 15 are all located on the longitudinal centre line of the vessel. In this way, a symmetric construction is obtained and weathervaning to both sides of the centre line of the vessel can take place around the bow anchor line 3 or the stem anchor line 5. As can be seen from FIG. 4, in this embodiment each anchor line 3,5 is connected to the seabed by means of three chains or cables 11,11',11" and 12,12',12" which extend from the counterweights 9,10 (not shown in FIG. 7) to the seabed.

Figure 8:
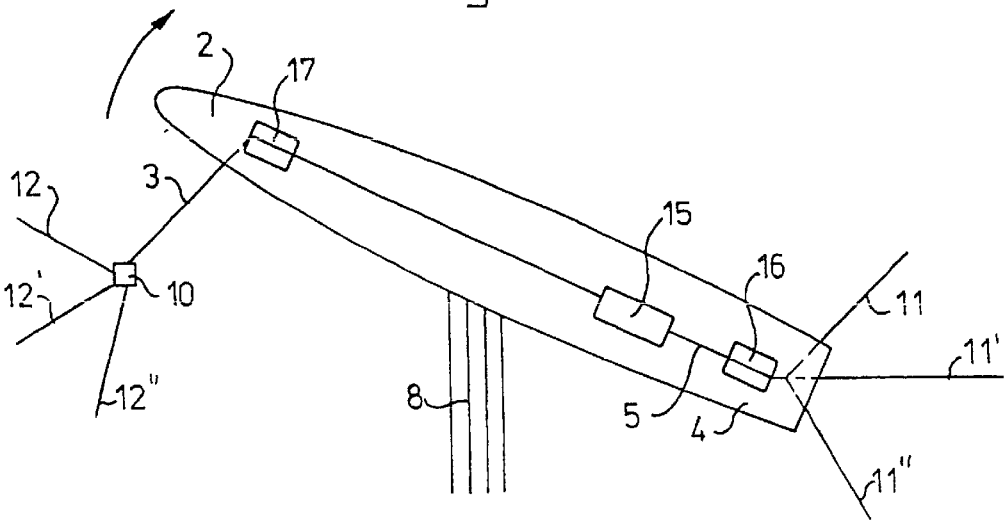
Figure 9:
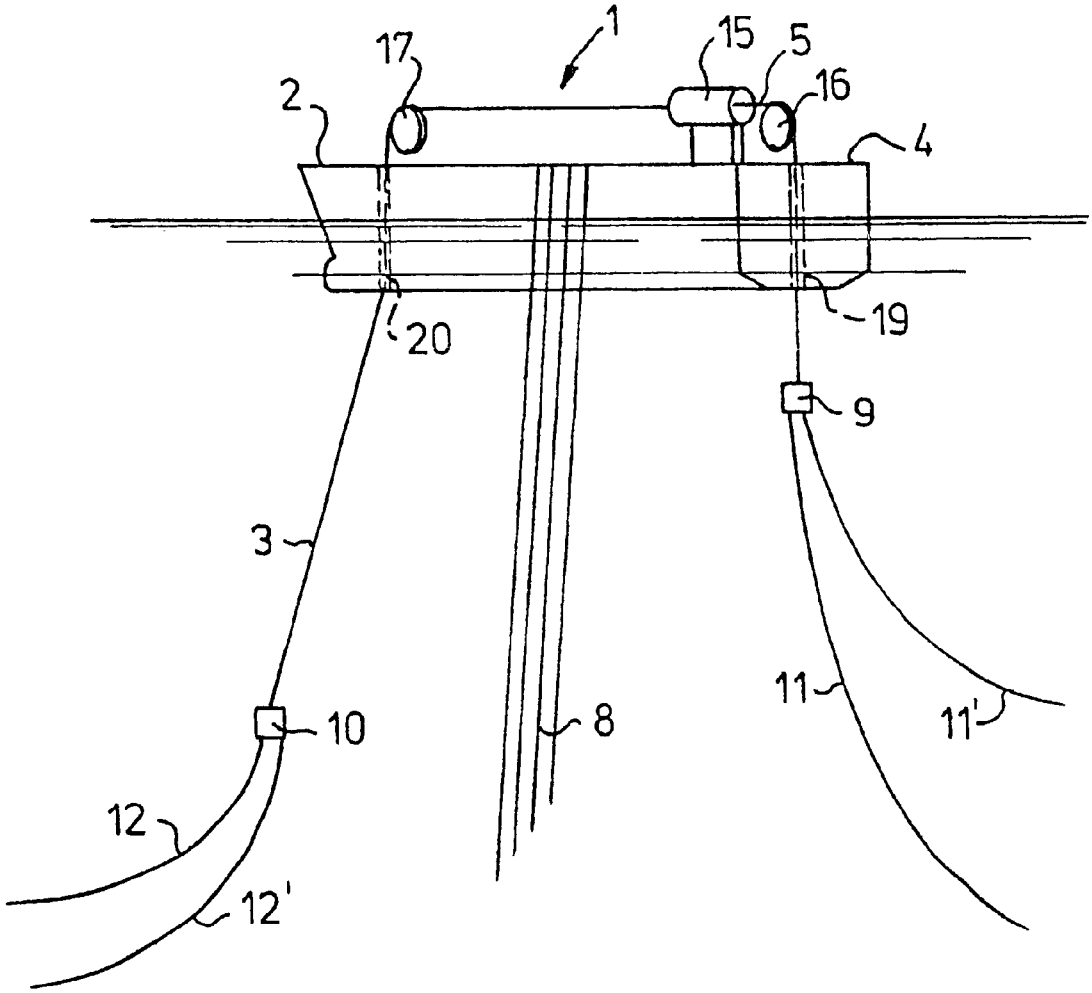
FIG. 9 shows a schematic perspective view of the embodiment using a single winch and a single anchor line as shown in FIG. 8.

FIG. 8 shows a situation in which the anchor line 3 at the bow is payed out and the anchor line at the stern is taken in, such that the vessel will weathervane around the stem anchor line 5 in the direction of the arrow as indicated. In this construction it is possible to use a single anchor line for the bow and stem anchor lines 3,5, such that the anchor line which is payed out at the bow corresponds to the length of anchor line which is taken in at the stem, as shown in FIG. 6.

What is claimed is:

1. A vessel comprising:

a first anchor line that is structured to take up mooring forces and that is connected at a substantially fixed position near a bow of the vessel;

a second anchor line that is structured to take up mooring forces and that is connected at a substantially fixed position near a stern of the vessel;

said first and second anchor lines each comprising a first anchor line section extending substantially vertically downward from said vessel, said first anchor line section of both of said first and second anchor lines extending substantially vertically downward to a respective connection point located below a keel level of the vessel, each of said first and second anchor lines further comprising at least two branching anchor lines that are each connected to said respective connection point and to respective fixed anchoring points on a sea bed, wherein adjacent to said respective connection point said at least two branching anchor lines enclose an acute angle and extend substantially vertically downward;

respective ballast weights connected to respective said first and second anchor lines adjacent to said respective connection points; and respective pulling devices connected to each of said first and second anchor lines that changes a paid-out length thereof so that both of said first and second anchor lines are maintained in a tensioned state and the vessel weathervanes around one of sa d first and second anchor lines.

2. The vessel of claim 1, further comprising a generally vertical shaft extending through a hull of the vessel from a deck level to a keel level, and wherein at least one of said first and second anchor lines extends through said shaft.

* * * * *